United States Patent [19]

Kotler

[11] 4,386,724

[45] Jun. 7, 1983

[54] CAMERA STRAP

[76] Inventor: Norman L. Kotler, 6420 Colewood Ct., Atlanta, Ga. 30328

[21] Appl. No.: 351,771

[22] Filed: Feb. 22, 1982

[51] Int. Cl.[3] ..... A44B 15/00

[52] U.S. Cl. ..... 224/255; 224/901; 24/204

[58] Field of Search ..... 224/255, 252, 250, 172, 224/901, 908, 909, 910, 915; 24/3 M, 3 K, 115 A, 129 B, 204, 306, 265 AL, 265 A, 265 EC

[56] References Cited

U.S. PATENT DOCUMENTS

| | | | |
|---|---|---|---|
| 3,305,148 | 2/1967 | Zimmerman . | |
| 3,507,424 | 4/1970 | Burkins . | |
| 3,884,403 | 5/1975 | Brewer . | |
| 3,886,773 | 6/1975 | McGahee | 224/255 X |
| 4,005,506 | 2/1977 | Moore | 24/204 X |
| 4,058,242 | 11/1977 | Brewer . | |
| 4,088,136 | 5/1978 | Hasslinger et al. | 224/901 X |
| 4,096,863 | 6/1978 | Kaplan et al. | 224/901 X |
| 4,168,022 | 9/1979 | Brewer . | |
| 4,320,863 | 3/1982 | Lyer et al. | 224/901 X |

*Primary Examiner*—Steven M. Pollard
*Attorney, Agent, or Firm*—George M. Thomas

[57] ABSTRACT

A support strap for supporting cameras, binoculars and similar items from the human body includes a flexible strap with connector means at one or both ends of the strap for connection to the camera, etc. The connector means includes a flexible string formed into a loop and having its end portions attached to the strap, a pair of hook and loop connector strips, the first of said hook and loop strips attached to the strap and the second strip pivotably mounted to move along the length of the strip toward and away from the first hook and loop strip, and a ring member pivotably attached to said strap and pivotable along the length of said strap to pivot toward and away from the first hook and loop strip. The loop of the string is extended through the opening of a camera support ring, etc., and is looped about the ring member, the ring member is folded over the string toward the first hook and loop connector strip, and the second hook and loop connector strip is connected about the ring member to the first hook and loop strip.

12 Claims, 7 Drawing Figures

CAMERA STRAP

BACKGROUND OF THE INVENTION

This invention relates to a support strap for supporting a camera, binoculars, or similar objects from the human body, and particularly to a support strap that makes a soft connection to the camera, which securely holds the camera in place and which can be rapidly manipulated to be connected to or to be released from the camera.

Cameras, binoculars, and other items that are usually hand held when in use are commonly fitted with straps so that they can be hung from the neck and shoulder area of the human body when not in use. In some instances it is highly desirable to be able to connect the camera, etc. to the belt at the waist. However, while hanging a camera about the neck and shoulder area usually permits the person to lift the camera to eye level for use, suspending a camera from a belt at the waist usually requires the strap to be disconnected from the camera or from the belt before the camera can be raised to eye level. In addition, it is highly desirable to make a "soft" connection to the camera; that is, it is desirable that the item fastened to the camera is not made of metal or some other hard substance that might tend to scratch or wear the case of the camera. Also, if a camera, etc. is to be connected to the belt at the waist of the wearer, it is highly desirable that the camera be expediently disconnected from and connected to its support straps, etc., so that immediate use of the camera can be obtained and convenient rehanging of the camera is available at the waist. Also, it is necessary that the connection made to the belt at the waist be secure so that the camera is not inadvertently dropped and damaged.

SUMMARY OF THE INVENTION

Briefly described, the present invention comprises a support strap for cameras, binoculars, or other items that are usually carried with a person. The support strap includes at one or at both ends a flexible string formed into a loop and having its end portions attached to the strap. A ring member is pivotably attached to the strap and is pivotable along the length of the strap at a position displaced further from the end of the strap than the string, and a pair of hook and loop connector strips is located at a third position along the length of the strap, with one of the strips connected flat to the strap and the other strip pivotably mounted to move along the length of the strap toward and away from connection with the first strip. The string is insertable through the support ring at the side of a camera, etc. and then is looped about the ring, the ring is folded over the string, and the pivotable hook and loop strip is connected to the ring and connected to the other hook and loop strip. This securely fastens the camera, etc. to the strap with a soft connection.

When it is desirable to release the strap from the camera, etc., the wearer of the support strap and camera simply pulls the outer hook and loop strip away from the inner strip, and upon releasing the outer strip, the ring pivots to release the looped string and the looped string slips through the camera ring, whereupon the camera is free.

Thus, it is an object of this invention to provide a support strap for supporting cameras and the like from the human body with a soft connection, and with a connection to the camera which is quick and easy to disconnect, and which is easy to reconnect.

Another object of this invention is to provide a camera strap with a secure connection to a camera, which is inexpensive to construct, which is durable, and which is convenient in use.

Another object of this invention is to provide a quick release camera strap which can be securely connected to a camera or similar object.

Other objects, features and advantages of this invention will become apparent upon reading the following specifications, when taken in conjunction with the accompanying drawings.

DETAILED DESCRIPTION

Figure 1:
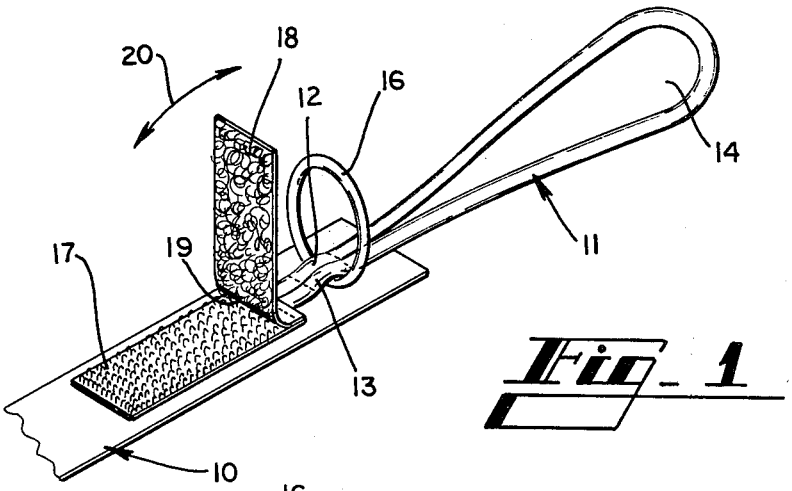
FIG. 1 is a perspective illustration of the end portion of the camera strap.

Referring now in more detail to the drawings, in which like numerals indicate like parts throughout the several views, FIG. 1 illustrates an end portion of a camera strap 10. The camera strap is formed from flat material, such as woven fabric material. A flexible string 11 has its end portions 12 and 13 sewn to strap 10, so that the string 11 is in the form of a loop with an opening 14. The loop generally extends along the length of the camera strap and beyond the end of the camera strap and pivots along the length of the strap.

Ring 16 is attached to camera strap 10 by sewing the ends 12 and 13 of the string 11 to the strap on opposite sides of the ring 16, so that the ring is pivotably connected to the camera strap.

Hook and loop connector strips 17 and 18 are mounted to strap 10 and extend along the length of the strap. Connector strips 17 and 18 are commonly known by the trademark "Velcro", with one of the strips 17 comprising a mass of pile loops, and the other strip comprising a mass of hooks, so that when the face of one strip is pressed against the face of the opposite strip, the hooks inner engage the loops, holding one strip to the other.

Connector strip 17 is sewn in flat abutment with strap 10, so that its connector face projects away from the surface of the strap. The other strip 18 is sewn at one edge portion 19 to the other strip 17 and to strap 10, so that strip 18 is pivotably connected to strap 10 as indicated by double-headed arrow 20.

When the end portion of the camera strap 10 is to be connected to a camera, binoculars, etc., the flexible string 11 is threaded through the opening 22 of a support ring 23 of a camera 24 or the like, and the free end of the string is looped over ring 16. Ring 16 is then pivoted away from the end portion of the strap toward overlying relationship with respect to strip 17, and strip 18 is inserted through the opening of ring 16 and pressed into engagement with the opposite strip 17. This causes a secure connection to be formed between camera strap 10 and camera 24. It will be noted that there are four lengths of the flexible string 11 that extend between the end portion of the camera strap and the camera, so that the camera is securely held to the strap.

Figure 2:
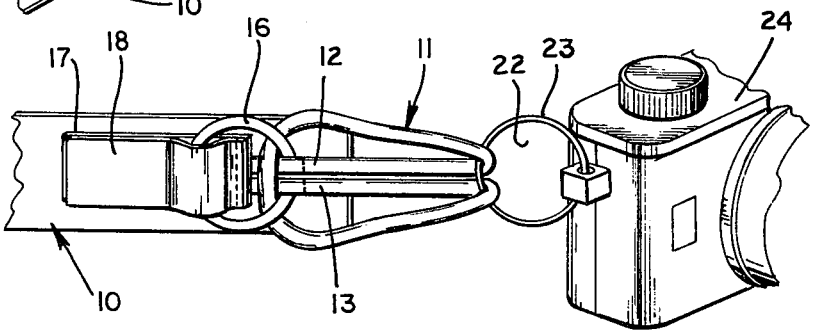
FIG. 2 is a plan view of the end portion of the camera strap, similar to FIG. 1, but showing the strap connected to a camera.
Figure 7:
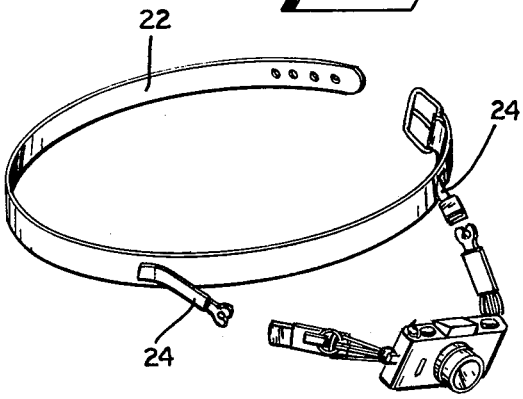
FIG. 7 is a perspective illustration of a belt, a camera to be worn at the belt, and the camera strap with disconnect buckles extending between the camera strap and the belt.
Figure 6:
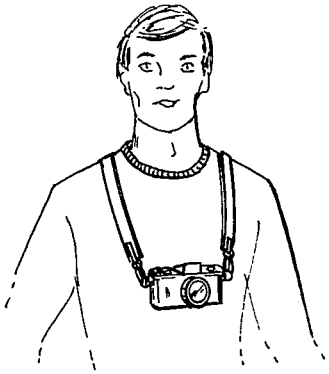
FIG. 6 is an illustration of the camera strap as it is connected to a camera and worn about the neck and shoulders of a person.

The camera strap as illustrated in FIGS. 1 and 2 can be a strap of the type to be worn about the neck and shoulders of a person as illustrated in FIG. 6, with connectors at both ends of the strap to attach to opposite sides of a camera. Also, the connector means can be formed at only one end of a camera strap, as illustrated in FIG. 7 where the camera straps are releasably connected to the belt 22 which is worn at the waist. In this embodiment, releasable buckles are connected to the other ends of the camera strap, with a male buckle 22 connected to one camera strap and female buckle 23 connected to the other camera strap. Short lengths of strap material 24 and 25 are permanently connected to belt 22, and male and female buckle elements 22 and 23 are connected to those strap lengths, so that the camera can be snapped to and unsnapped from connection with the belt 22. In addition, since both male and female buckle elements 22 and 23 are connected to the camera straps, these elements can be connected together at the rear of the camera to form a short strap that permits the camera to be temporarily suspended from the arm, etc.

Figure 3:
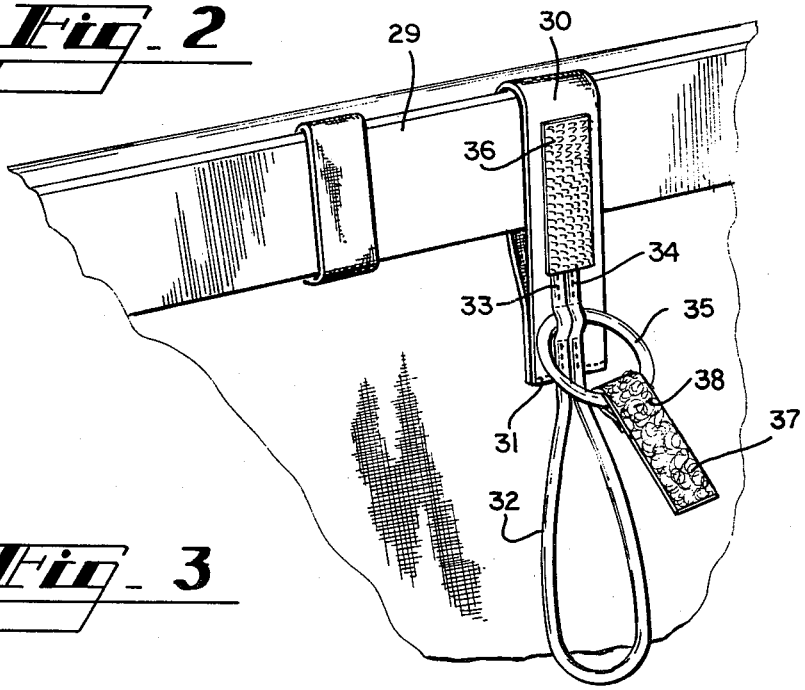
FIG. 3 is a perspective illustration of a modified form of the camera strap, showing the camera strap attached to the belt at the waist.
Figure 4:
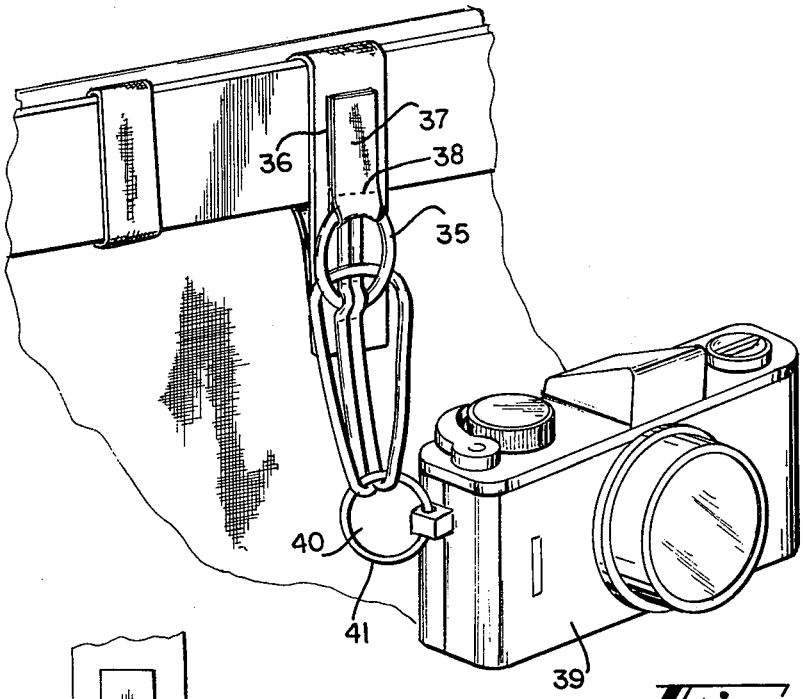
FIG. 4 is a perspective illustration of the camera strap of FIG. 3, showing the strap connected to a camera.

As illustrated in FIGS. 3 and 4, another embodiment of the invention is disclosed wherein the camera strap is formed as a belt loop for extending about the belt 29 at the waist of the user. The camera strap 30 is formed in a loop by the stitching 31 at its ends. The flexible string 32 has its end portions 33 and 34 stitched to strap 30 on opposite sides of ring 35. One of the hook and loop connector strips 36 is sewn in flat abutment with strap 30, while the other hook and loop connector strip 37 is looped about ring 35 and sewn thereto with a line of stitching 38.

As illustrated in FIG. 4, when the camera strap of FIGS. 3 and 4 is to be connected to a camera, the string 32 is inserted through the opening 40 of a camera support ring 41 and then looped over ring 35. Ring 35 is then pivoted up toward hook and loop connector strip 36 and the opposite hook and loop connector strip 37 is pressed against strip 36. Again, this forms a firm connection for the camera 39.

Figure 5:
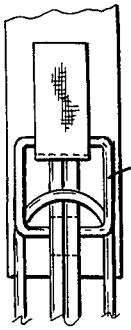
FIG. 5 is a detail illustration of the end portion of the camera strap, showing a rectangular ring.

The rings 23 and 35 of FIGS. 1–4 are illustrated as being circular. As illustrated in FIG. 5, the ring can be non-circular, as shown by rectangular ring 43.

While the flexible string 11 has been described as "string" it will be understood that the string can be made of various woven cords, from leather and other suitable materials. Moreover, while the hook and loop connector strips 17, 18 and 36, 37 have been disclosed as being the ring holder to hold the ring against pivotal movement, it will be understood that various other type ring holders such as a strap with a snap or other connector can be utilized, if desired.

While this invention has been described in detail with particular reference to a preferred embodiment thereof, it will be understood that variations and modifications can be effected within the spirit and scope of the invention as described hereinbefore and as defined in the appended claims.

What is claimed is:

1. A support strap for supporting cameras and the like from the human body comprising a flexible strap, a flexible loop string connected to said strap, and a pair of matable hook and loop strips, with the first of said hook and loop strips attached in flat abutment to said strap and the second of said hook and loop strips mounted to pivot toward and away from the first hook and loop strip to overlap and connect to and open and disconnect from said first hook and loop strip, a ring member pivotably mounted to said strap with the portion of said ring member remote from the pivot portion thereof being pivotable into the overlap of said hook and loop strips so that said hook and loops can be pressed together to hold said ring member, whereby the free end portion of the flexible loop string first is extended through the opening of a camera support ring or the like and then is looped about the ring member, the ring member is pivoted toward the first of the hook and loop strips, and the other of the hook and loop strips is connected to the first of the hook and loop strips with the ring extending through the overlap of the hook and loop strips.

2. The support strap of claim 1 and wherein said flexible strap comprises a belt loop for hanging from a belt.

3. The support strap of claim 1 and wherein said second hook and loop strip is mounted at one end portion to said strap.

4. The support strap of claim 1 and wherein said second hook and loop strip is mounted to said ring member.

5. The support strap of claim 1 and wherein said flexible loop string has its end portions extending through said ring members and attached to said strap on both sides of said ring member to pivotably mount said ring member to said strap.

6. The support strap of claim 1 and wherein said ring member is circular.

7. The support strap of claim 1 and wherein said ring member is non-circular.

8. The support strap for supporting a camera or the like from the human body comprising an elongated strap, a flexible string formed into a loop and having its end portions attached to said strap, a pair of hook and loop connector strips, the first of said hook and loop strips attached to said strap and the second of said hook and loop strips pivotably mounted to move along the length of said strap toward and away from said first hook and loop strip, a ring member pivotably attached to said strap and pivotable along the length of said strap away from said first hook and loop strip, whereby the loop of the string is extended through the opening of a camera support ring or the like and is looped about the ring member, the ring member is pivoted over the string toward the first hook and loop connector strip, and the second hook and loop strip is connected about the ring member to the first hook and loop strip.

9. A support strap for supporting a camera or the like from the human body comprising an elongated strap, a flexible string formed into a loop and having its end portions attached to said strap at the end portion of said strap, a ring member pivotably connected to said strap at a position adjacent said looped string away from the end portion of said strap, a ring member pivotably connected to said strap at a position adjacent said looped string away from the end portion of said strap, and a ring holder connected to said strap adjacent said ring away from the end portion of said strap, whereby said looped string is extended through the opening of a camera support ring or the like and looped about the ring member, the ring member pivoted over said string, and the ring holder connected to said ring.

10. The support strap of claim 9 and wherein said ring holder comprises a pair of hook and loop strips with the first one of said strips fastened flat against said strap and the other of said strips movable toward and away from said first strip to hold said ring member pivoted over said string.

11. The support strap of claim 9 and wherein said support strap is formed in a loop for extending about a belt or the like.

12. The support strap of claim 9 and wherein said flexible string overlaps said ring member and said ring holder.

* * * * *